US012758854B2

(12) United States Patent
Williams

(10) Patent No.: US 12,758,854 B2
(45) Date of Patent: Oct. 13, 2026

(54) PROTECTIVE COLLAR ASSEMBLY FOR HELMETS

(71) Applicant: Brian Williams, Jupiter, FL (US)

(72) Inventor: Brian Williams, Jupiter, FL (US)

( * ) Notice: Subject to any disclaimer, the term of this patent is extended or adjusted under 35 U.S.C. 154(b) by 0 days.

(21) Appl. No.: 19/256,759

(22) Filed: Jul. 1, 2025

(65) Prior Publication Data

US 2026/0131220 A1 May 14, 2026

Related U.S. Application Data

(60) Provisional application No. 63/719,399, filed on Nov. 12, 2024.

(51) Int. Cl.
*A63B 71/12* (2006.01)
*A41D 13/05* (2006.01)
*A42B 3/04* (2006.01)

(52) U.S. Cl.
CPC ..... *A63B 71/1291* (2013.01); *A41D 13/0512* (2013.01); *A42B 3/0473* (2013.01)

(58) Field of Classification Search
CPC ..... A63B 71/1291; A42B 3/0473; A41D 13/0512; A61F 5/055; A61F 5/05883
See application file for complete search history.

(56) References Cited

U.S. PATENT DOCUMENTS

| | | | | |
|---|---|---|---|---|
| 6,182,300 | B1 * | 2/2001 | Severance | A63B 71/1291 2/468 |
| 10,602,793 | B1 * | 3/2020 | Williams | A63B 71/1291 |
| 2004/0128744 | A1 * | 7/2004 | Cleveland | A41D 13/0512 2/425 |
| 2009/0044314 | A1 * | 2/2009 | Newman | A42B 3/0473 2/468 |
| 2009/0204041 | A1 * | 8/2009 | Powell | A61F 5/055 602/18 |
| 2012/0291183 | A1 * | 11/2012 | Janisse | A42B 3/0473 2/411 |
| 2017/0065016 | A1 * | 3/2017 | Chuback | A42B 3/0473 |
| 2020/0128900 | A1 * | 4/2020 | Trevillion | A42B 3/0473 |

* cited by examiner

*Primary Examiner* — Aiying Zhao
(74) *Attorney, Agent, or Firm* — McHale & Slavin, P.A.

(57) ABSTRACT

A protective collar assembly to distribute impact forces during various sporting events. The protective collar is constructed and arranged to reduce compression from impacts on a helmet by dispersing loads across the shoulders and chest of the wearer. The assembly includes a cowl with a base support and an outer bearing ring featuring notches and undercuts for secure, rotatable attachment. A ball bearing assembly in the outer ring enables frictionless, limited head rotation, with safety tabs to prevent over-rotation. An inner bearing ring further stabilizes the bearings, while a flexible, tear-resistant fabric cover restricts unsafe head movement. The top ring connects to a helmet via a quick-release mechanism, allowing secure attachment and easy removal.

7 Claims, 8 Drawing Sheets

PROTECTIVE COLLAR ASSEMBLY FOR HELMETS

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 63/719,399, entitled "PROTECTIVE COLLAR ASSEMBLY FOR HELMETS", filed Nov. 12, 2024. The contents of the above referenced application are incorporated herein by reference in its entirety.

FIELD OF THE INVENTION

The present invention is directed to the field of sports protective equipment and, more particularly, to a protective collar assembly for use with a helmet for inhibiting head and neck injuries.

BACKGROUND OF THE INVENTION

There remains a concerted effort throughout the sports industry to develop equipment to better protect athletes from suffering head and neck injuries while playing sports, particularly contact sports like football. Many sports are mandating helmets be worn, or are contemplating the need for helmets, even if impact injuries are not expected. For instance, spinal injuries from over rotation of the neck are known to occur in football, soccer, ice hockey, rugby, martial arts, skiing, snowboarding, snowmobiling, bicycling, horseback riding and so forth. Injuries are not simply caused by head-to-head or head-to-ground impact. Injuries occur as the result of any impact that causes the head and brain to move rapidly back and forth in a whiplash-like fashion. The sudden movement causes the brain to bounce or twist around inside the skull, stretching and damaging the delicate cells and structures inside of the brain. Football players are at significant risk of injuries due to the high-impact nature of the game which involves tackles, collisions, and falls, all of which can put immense stress on the spine. While not expected, an individual may be injured while horseback riding where spinal injuries can range from mild strains and disc herniations to severe injuries like spinal fractures, spinal cord injuries, and even paralysis. The cervical spine (neck region) is especially vulnerable, as head-hits can cause whiplash, over rotation of the neck, which can easily result in paralysis.

High school and professional athletes suffer thousands of injuries every year. It is recognized that concussions can lead to permanent loss of higher level mental processes, and spinal injuries can be debilitating. Cervical spinal injuries may occur together with a concussion, and an effort must be made to lessen both such injuries. Combining a device to prevent over rotation of the neck with an anti-concussion collar is an improvement in the technology.

RELATED PRIOR ART

This invention is related to the inventors previous U.S. Pat. No. 10,602,793 entitled Anti-Concussion Collar Assembly and Method of Use issued Mar. 31, 2020, the contents of which is incorporated herein by reference. The anti-concussion helmet attachment collar assembly includes a cowl body attached to a curved helmet attachment ring segment at its upper end, and to a cowl support ring at its lower end. A circular rolling element bearing is interposed between the bottom of the cowl support ring and the interior shoulder Of an underlying central ring, facilitating rotation of the cowl support ring with respect to the central ring. A modified helmet incorporates a flange with keyhole openings couplable with standoff rivets on the helmet attachment ring segment. A base attached to equipment, such as football shoulder pads, is configured to selectively couple with the central ring during use.

SUMMARY OF THE INVENTION

A protective collar assembly designed to disperse impact forces on a user's head and neck includes: a cowl that serves as a receiver for the bottom of the collar assembly, attachable to shoulder pads or positionable over the shoulders, shaped to reduce compression forces by distributing impact loads. Preferably the cowl is formed integral with shoulder pads. Inside the cowl, a thick circular base support with a central opening features spaced notches along the sidewall that engage tabs on an outer bearing ring, locking into place via rotation. The outer bearing ring houses a ball bearing assembly with sealed bearings for low-friction rotation, including safety tabs to prevent excessive head movement. An inner bearing ring retains the bearings, with tabs interacting with the outer ring's safety tabs to limit rotation. A flexible, tear-resistant fabric cover is secured with a tongue and groove attachment and a fail-safe fastener. A top ring above the fabric attaches to a helmet, enabling controlled movement with a quick release locking system.

An objective of the invention is to provide a protective collar assembly for use with helmets that reduces or prevents spinal and concussion injuries.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention. Like reference numerals refer to like parts throughout the several views of the drawings.

DETAILED DESCRIPTION OF THE PREFERRED EMBODIMENT

Figure 1:
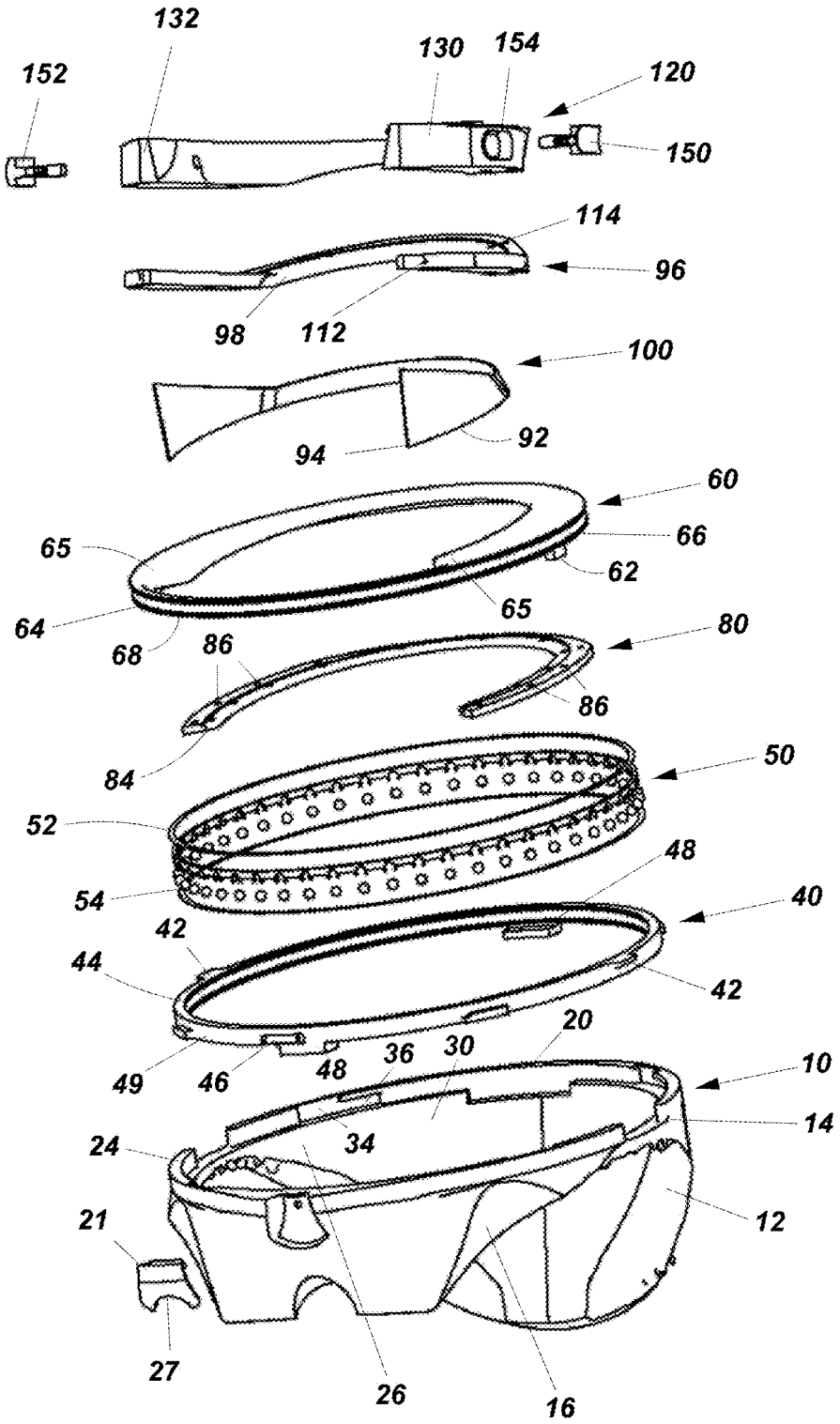
FIG. 1 is an exploded perspective view of the present invention.
Figure 2:
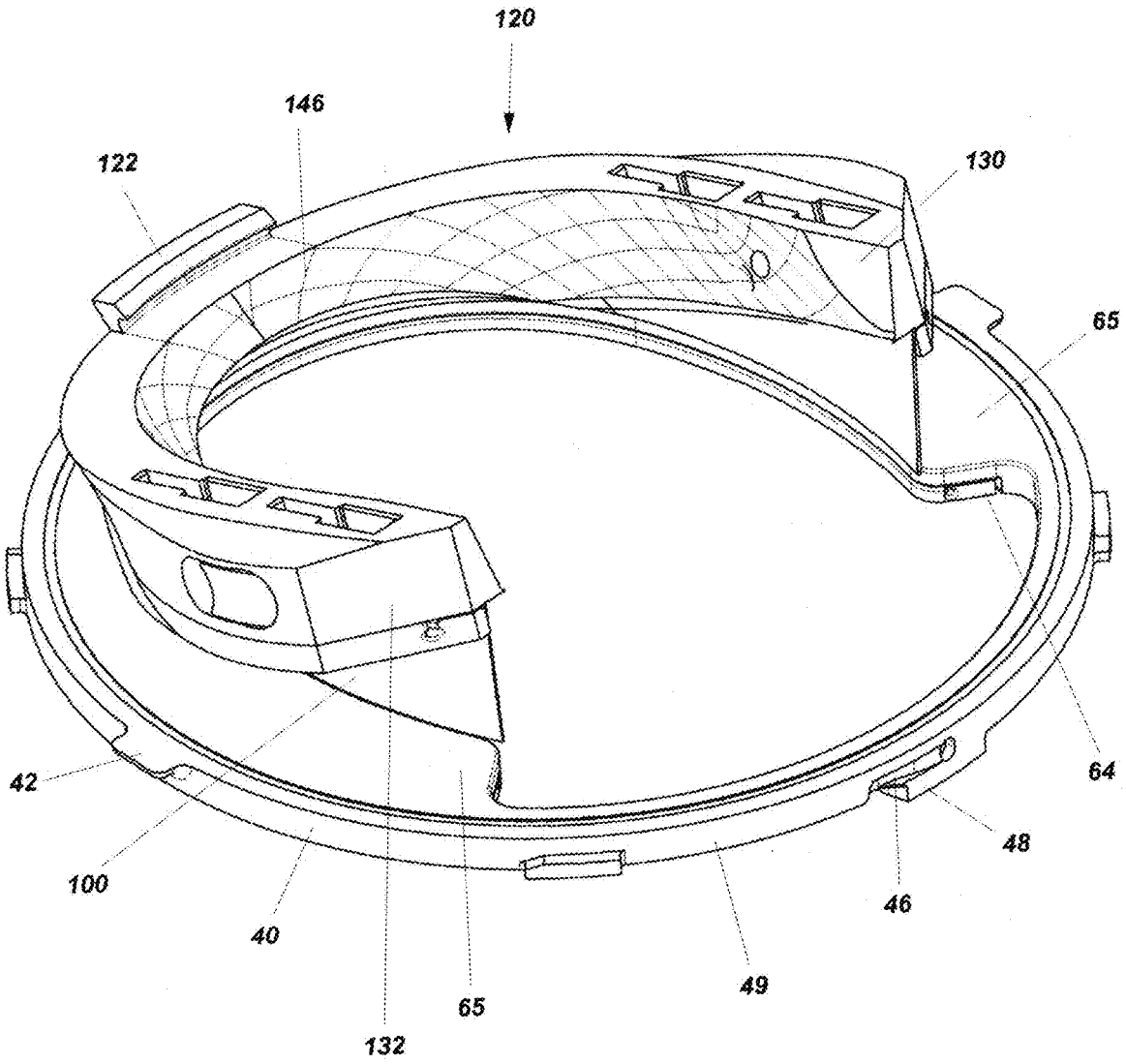
FIG. 2 is a perspective view of the collar assembly in accordance with an exemplary implementation of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. The implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. Furthermore, in the description that follows, like parts are marked throughout the specification and drawings with the same reference numerals respectively. drawing figures are not necessarily to scale and in certain views proportions may have been exaggerated for purposes of clarity.

A cowl 10 provides a receiver and connection point for the bottom of a collar assembly. The cowl having a substantially circular sidewall 12 that can be attached to shoulder pads or placed over an individual's shoulders with alignment slot 14. Shaped lower edge 16 is constructed and arranged for placement over an individual's chest or back, the shape of which is designed to distribute the loading of a direct hit on a helmet wherein the cowl distributes the forces to reduce or eliminate the head and cervical neck from undue compression. As will be apparent to those skilled in the sports equipment arts, the cowl has a flexible configuration and a design that is highly adaptable for use with any of a variety of different types of underlying sports equipment gear including, by way of example and not limitation, football shoulder pads, a fire suit donned by a race car driver, and so forth.

The cowl has a base support 20 which is generally defined by a thickened circular peripheral sidewall 24. An edge 26 provides an inwardly shaped ridge from the peripheral sidewall 24 to define a central opening 30. The base support 20 would incorporate a corresponding engagement structure for facilitating coupling of the base 20 support to any underlying sports equipment, such as football shoulder pads. Circular peripheral sidewall 24 is provided with a series of spaced-apart notches 34 extending into the interior peripheral sidewall 24, each notch 34 contiguous with an undercut 36. During assembly, spaced-apart tabs 42 on a outer bearing ring 40 are received through the corresponding base notches 34 and locked in place by rotation into the undercut 36. For placement, the outer bearing ring 40 is rotated in a clockwise direction. In addition to providing locking engagement, the tabs 42 also function as lifting tabs that enable manual removal of the collar assembly from the cowl 10 when disengaged. A user may grasp or apply upward force at the lifting tabs 42 to facilitate separation from the cowl 10.

The cowl 10 will allow an impact force that is being transmitted either from the head or adjoining collar assembly to be dispersed into a wider area onto the shoulders, chest, and back to allow reduced force on the spine. At the interface surface between the cowl and the collar assembly, the notches will allow the collar assembly to be dropped into the cowl and rotated and locked so that the collar assembly cannot be removed. A pair of spaced-apart left and right ring rotation stop limit features 65 extend outwardly therefrom provides a leading edge protector to the fabric 100. When used in combination with shoulder pads 101, in the preferred embodiment the cowl and shoulder pads are preferably manufactured as a single piece. Shoulder pads 101 are illustrated but not a representation of a single piece assembly.

Cowl locking pins 19 provide a locking mechanism once the collar assembly is inserted and twisted into the cowl. The pins lock the components together. In a preferred embodiment, the pins are in the form of a spring-loaded plunger pin that can be engaged or disengaged and remains on the cowl at all times. Each locking pin 19 is part of a latch assembly that includes a collar latch lever 21, which sits flush against the outer front face of the cowl 10 when in the locked position. The collar latch lever 21 can be manually lifted via a bottom cutout 27 to retract the locking pin 19 and disengage the collar assembly. A collar latch plunger pin 23 secures the locking pin 19 to the collar latch lever 21 through a clevis-lug style interface. A collar latch spring 25 is concentrically mounted around the shaft of the locking pin 19 within a bore in the cowl 10 and exerts a linear force to bias the locking pin 19 into the locked position. This spring-loaded latch system ensures a secure engagement between the collar assembly and the cowl while allowing for manual disengagement when desired.

The inner surface 44 of the outer bearing ring 40 is sized to receive a ball bearing assembly 50 which includes a race 52 which keeps the ball bearings 54 in alignment. Bearing seals 56 are positioned above and below the ball bearing assembly 50 to protect the bearing components from debris intrusion and to retain lubricants within the sealed structure. The ball bearing assembly 50 allows the user to rotate their neck left to right or right to left with little to no friction. The ball bearings are sealed so all friction reducing additives for the ball bearing (i.e. grease, lube) will be concealed within these seals and will require no maintenance by the user. This particular configuration is commonly referred to as a thrust bearing. However, the invention is not intended to be so limiting. To the contrary, applicant contemplates incorporating any of myriad known types of circular rolling element bearings providing substantially free-spinning rotation of cowl subassembly (albeit, limited by rotational engagement of support ring stop feature with left and right central ring rotation stop limit feature). In this manner, the rolling element bearing enables substantially friction-free rotation of a user's helmet-protected head within maximum degree of rotation limits defined, or established, by rotation-limiting features. Tabs 48 on the bottom horizontal surface 49 operate as safety stops to keep a user from over rotating their head and neck. A ramp and slot feature 46 may also be formed adjacent to the locking tab structure on the outer bearing ring 40. This feature provides a sloped guiding surface that assists in alignment and engagement of the collar latch plunger during insertion into the cowl 10. The sloped ramp enables the plunger to slide into the locking slot smoothly and securely without requiring precise manual alignment.

An inner ball bearing ring 60 keeps the ball bearings 54 in place and is part of the race that allows the user frictionless rotation within a predetermined range. Tabs 62, 64 formed along the outer vertical wall 66 are spaced 180 degrees apart from each other. The tabs 62, 64 interact with safety tabs 48 to keep the user from over rotating their head and neck providing safety stops. The inner ball bearing ring 60 employs threaded holes 68 for use in attaching fabric 100 by use of a bottom fabric cover 80 to the inner ball bearing ring 60. Fastener holes 68 are in line with fastener holes 86 for securing the fabric 100 thereto. The bottom fabric cover 80 is attached to the inner ball bearing ring 60 together with the bottom edge 92 of the fabric 100 using a tongue 94 and groove 84 attachment along the arc length of fabric cover 80. The groove 84 is formed in the bottom fabric cover 80 which allows the fabric 100 to be held in place using a slight undersized flexible cylindrical nylon or a like shaped component which acts as the tongue. The fabric 100 is held in place by wrapping the bottom of the fabric around the nylon cylindrical-shaped component and sliding it through and along the groove 84 of the inner ball bearing ring 60. It also has through holes 86 that allow for fasteners, not shown, to be used as fail safe to prevent disconnection during a forceful impact. This connects the bottom fabric cover 80 to the inner ball bearing ring 60. The fabric 100 secures the top of the collar assembly to the bottom of the assembly and allows additional movement of the head outside of the movement allowed by the bearing assembly. The fabric 100 also acts as a safety stop to not allow the head to extend any further past the allowable threshold for flexion, extension, and side bending.

In one embodiment the fabric 100 is a ballistic nylon. The fabric 100 is constructed from a flexible, deformable member fixedly attached to the top fabric cover 96. In another embodiment Kevlar, reinforced leather, or the like tear resistant fabric which allows uninhibited movement of the helmet and to an arresting point. In a preferred embodiment the fabric 100 limits the rotation to a predetermined position that, should it be exceeded, would otherwise place the wearer at risk form overextending the neck. This prevention of movement is to prevent the movement of the head into a recognized harmful position. It should be noted that, for the purpose of clarity, the height of the fabric 100 represented in the figures does not accurately reflect the height of the fabric 100 in proportion to the rest of the structure of collar assembly. Although the invention is not intended to be limiting vis-vis the height of the fabric 100, the fabric 100 preferably includes a cutout portion to expose the wearer's face and/or neck region. The ring segment is particularly designed to facilitate the donning, and subsequent removal, of a helmet. For that purpose, significantly, the ring segment incorporates structure for enabling and facilitating selective, releasable coupling to a helmet 140.

The fabric 100 is attached to the top fabric cover 96 using a groove 112 that runs along the arc length of the fabric cover 96. The groove 112 holds the fabric 100 in place using a slight undersized flexible cylindrical nylon or nylon like shaped component 98 which acts as a tongue for a tongue and groove attachment. The fabric 100 is held in place by wrapping the fabric around the nylon cylindrical-shaped component 98 and sliding it through and along the groove 112. The top fabric cover 96 also has through holes 114 that allow for fasteners to be used as fail safe catch.

The top fabric cover 96 is securable to a top ring 120, also referred to as a top collar, which allows a helmet 140 to interact with the ball bearing assembly, elements 40, 50, and 60. At rest, there is a gap between the top ring 120 and the bearing assembly to allow movement for the user. The top fabric cover 96 gets fastened to the top ring 120, and the top ring 120 connects to a receiver 142 on the helmet 140. The receiver 142 is a structural interface on the helmet 140 configured to receive and secure the top ring 120 of the protective collar assembly. The current design has the top ring 120 sliding in from the rear of the helmet 140 wherein inserts 130, 132 are placed within the helmet receivers 142, 144 using a tongue and groove interface and locking into place.

In addition to locking pins 145, the top ring 120 includes a first latch 150 and a second latch 152 disposed on opposing lateral sides of the top ring. Each of the latches 150, 152 includes a latch pin 158 configured to project into a corresponding first aperture 154 and second aperture 156 formed on the helmet receivers 142, 144. Each locking pin 145 is biased into the locked position by a spring 160 positioned concentrically around the pin shaft within a bore in the top ring 120. Upon engagement, the latch pins 158 secure the top ring 120 to the helmet 140 to prevent detachment during use. Bracket 146 prevents the helmet 140 from rearward movement so that the helmet cannot over rotate backwards.

Figure 3:
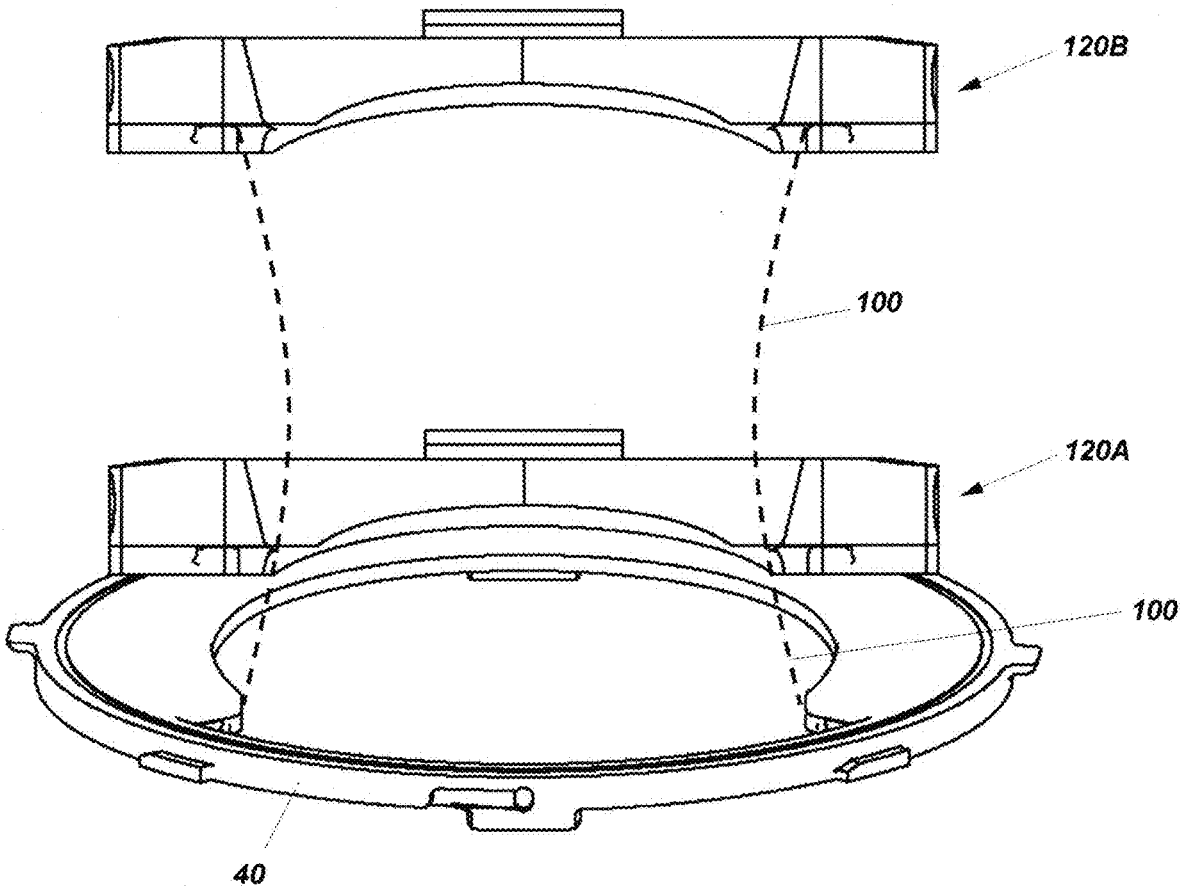
FIG. 3 is an elevated front plan view of the cowl and cowl support ring subassembly.
Figure 4:
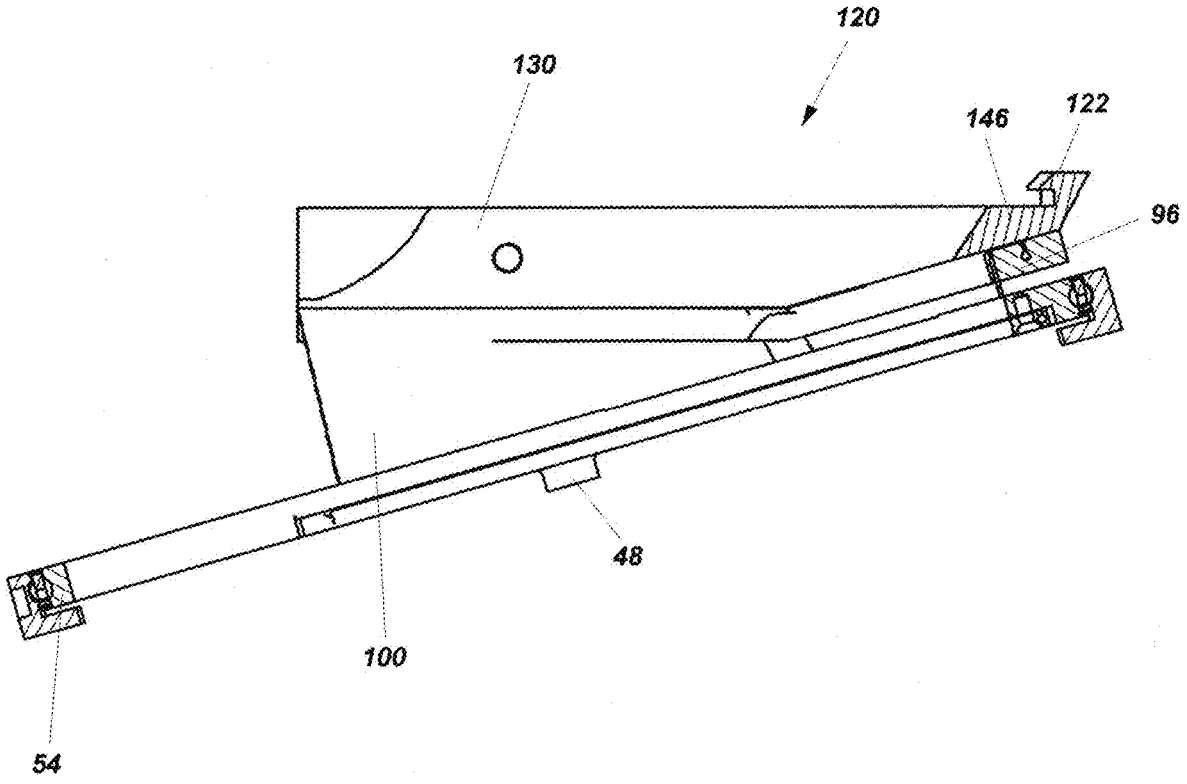
FIG. 4 is a cross sectional side view of the collar assembly.
Figure 5:
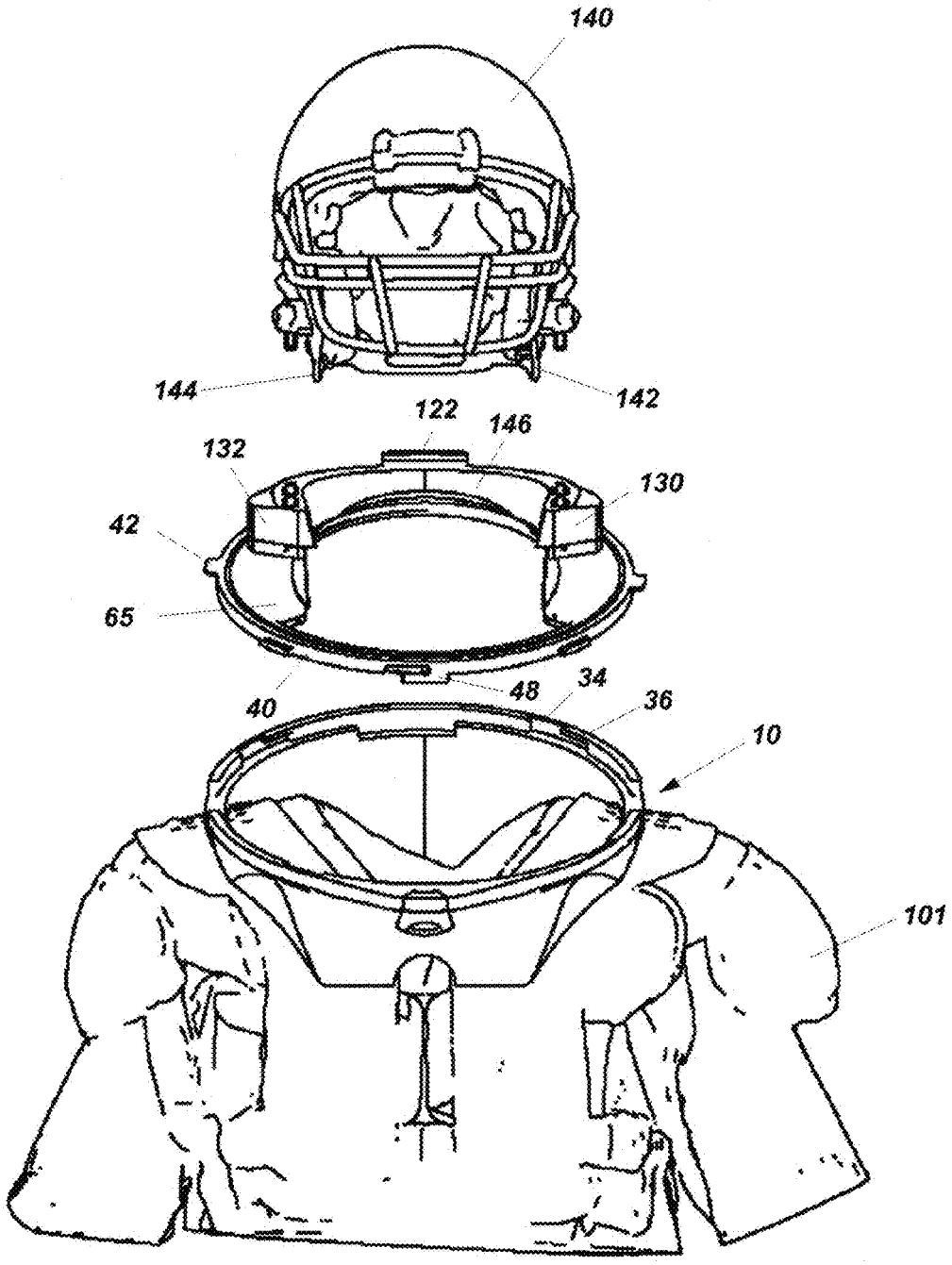
FIG. 5 is a top front partially exploded view of the collar assembly in a partially assembled state
Figure 6:
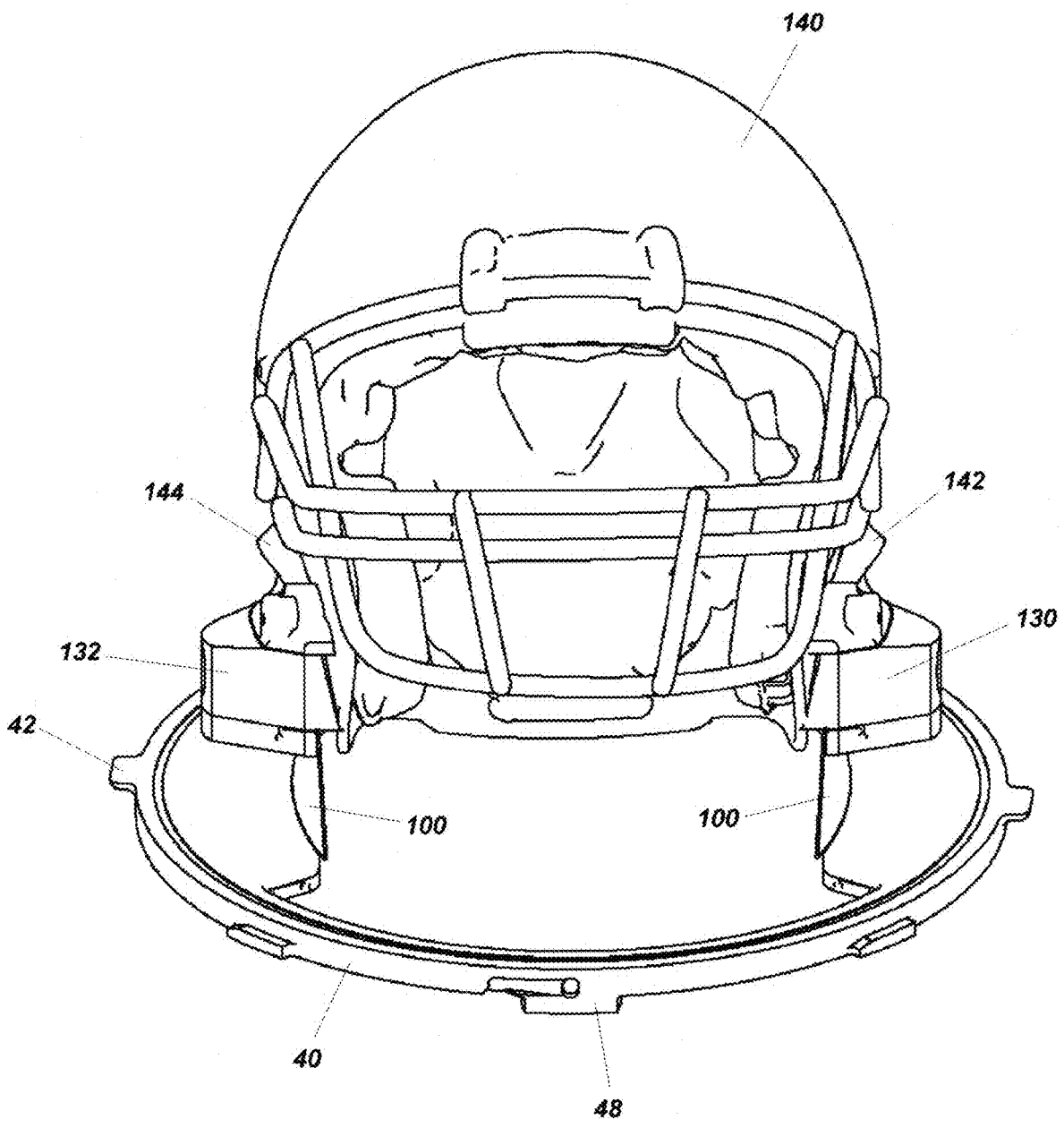
FIG. 6 is a front view of the collar assembly depicted in a fully assembled state with a helmet.
Figure 7:
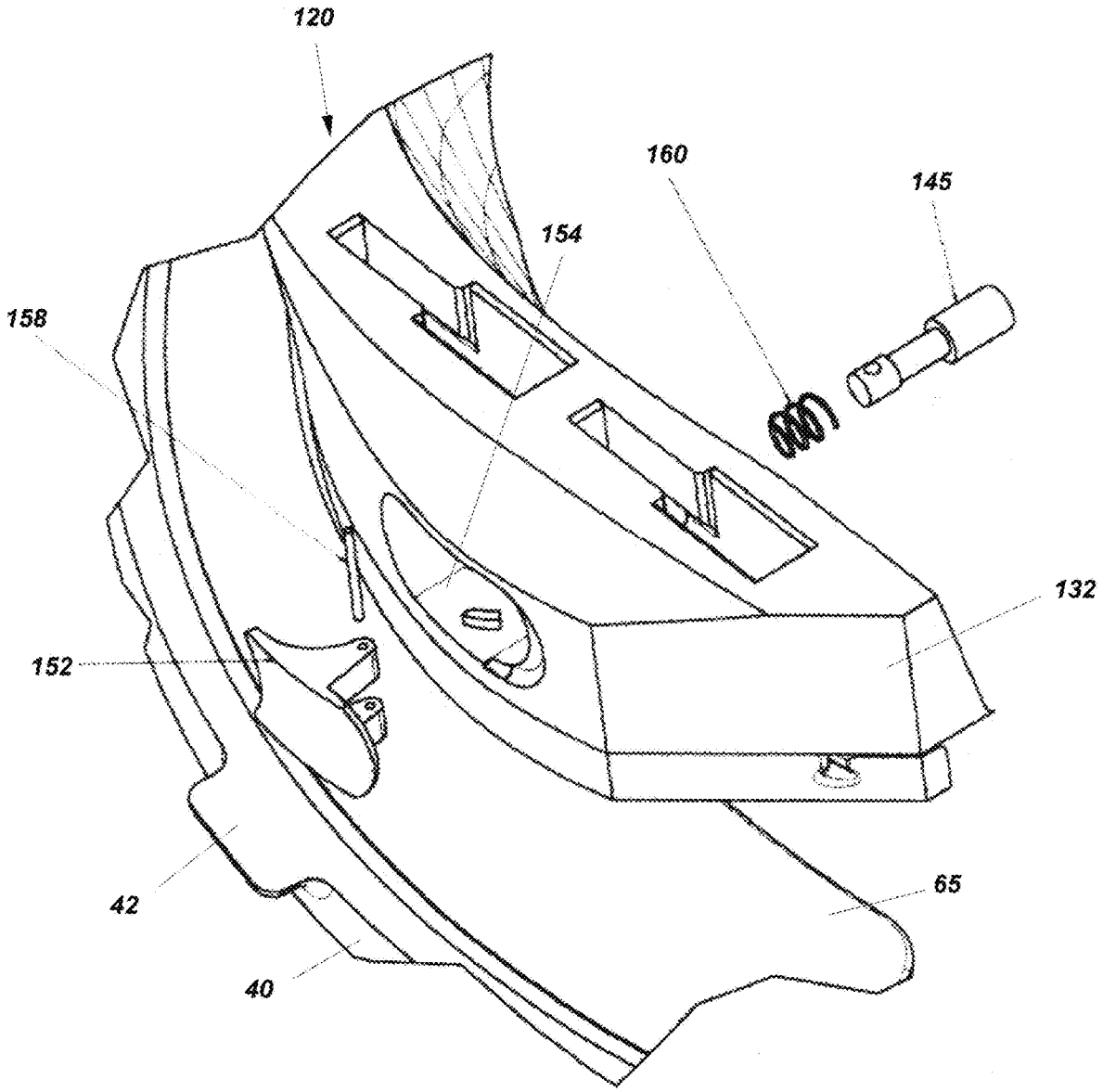
FIG. 7 is a detailed view of the collar-to-helmet latch assembly.
Figure 8:
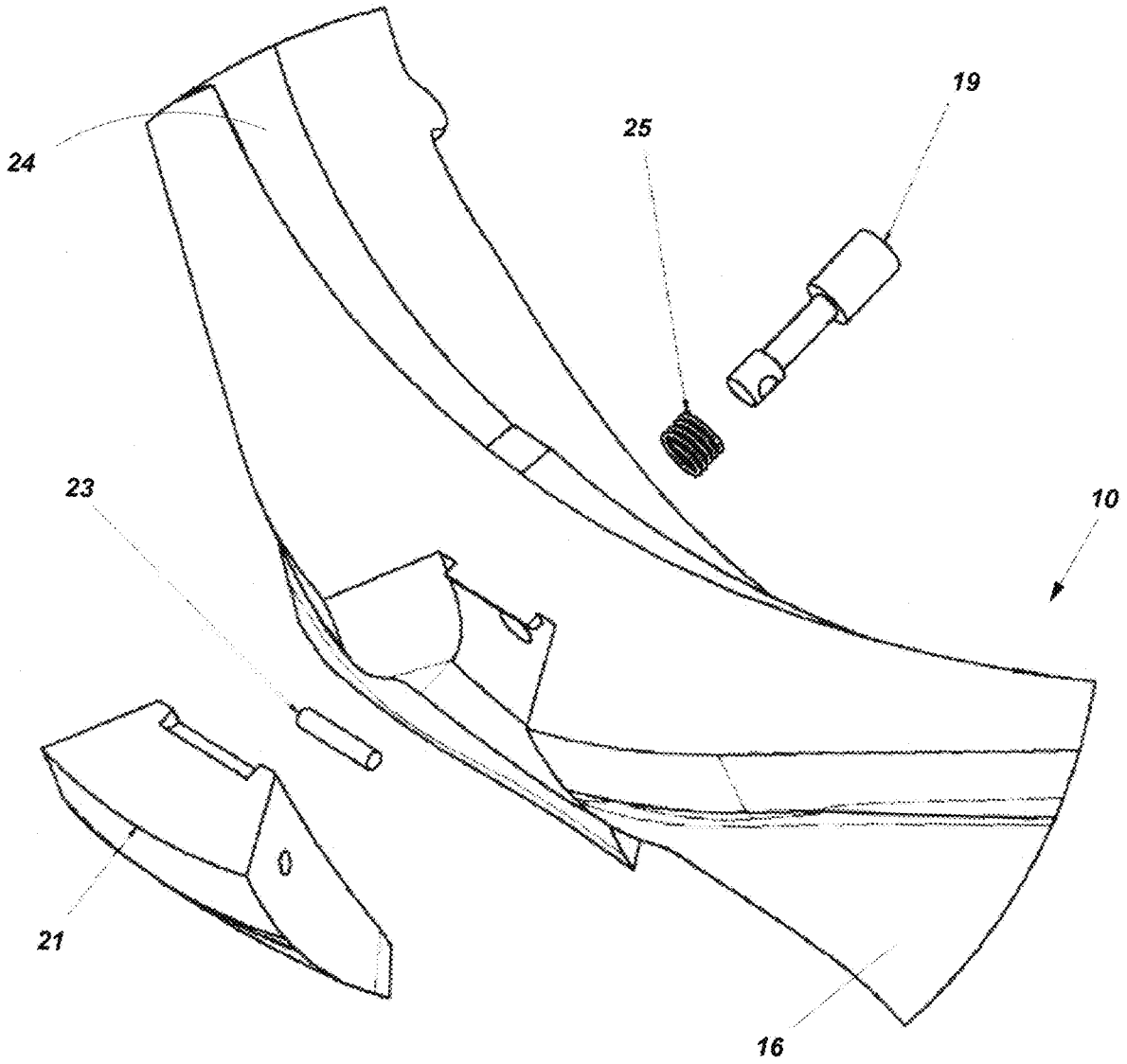
FIG. 8 is a detailed view of the cowl-to-collar latch assembly.

In some embodiments, a tenon joint feature 122 may also be formed along the rear side of the top collar 120 to provide structural alignment and rearward rigidity of the collar assembly. The tenon joint feature 122 is configured to interlock with a corresponding mortise-like structure on the adjoining helmet receiver or structural interface, thereby preventing lateral play and improving the stability of the helmet when connected. FIG. 3 depicts the top ring 120A in a compressed position with the fabric 100 folded, and top ring 120B in an expanded state with the fabric 100 extended to its limit.

The connection point will be a quick release mechanism to allow the user to remove the helmet easily and efficiently. The locking pins 145 allow quick removal of the helmet 140 due to the pins being arranged so that there is a single point of locking and unlocking.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention is not limited to the particular embodiments disclosed as the best mode contemplated for carrying out this invention, but that the invention will include all the embodiments falling within the scope of the appended claims.

What is claimed is:

1. A protective collar assembly for distributing impact forces on an individual's head and neck, comprising:

a cowl configured to provide a connection point for a bottom of the protective collar assembly, the cowl attachable to shoulder pads or positionable over an individual's shoulders, the cowl having a shape configured to distribute impact loads by reducing compression forces on the individual's head and neck, a base support within the cowl defined by a thickened circular peripheral sidewall with a central opening and having notches spaced apart around the peripheral sidewall, each notch contiguous with an undercut;

a spring-loaded collar latch assembly comprising a locking pin, a collar latch lever secured to the locking pin via a plunger pin, and a collar latch spring positioned concentrically around the locking pin to bias it into a locked position;

an outer bearing ring containing a ball bearing assembly that provides frictionless rotation of the individual's head within a predetermined range, the ball bearing assembly formed from a race with sealed ball bearings to provide rotation, and safety tabs positioned on the outer bearing ring to prevent over-rotation of the individual's head and neck, wherein the safety tabs can engage with the notches of the thickened circular peripheral sidewall and be locked in place by rotation into the undercuts of the cowl, and wherein the outer bearing ring further includes a ramp and a slot, the ramp configured to guide a plunger component of the spring-loaded collar latch assembly into a corresponding locking position;

an inner ball bearing ring for retaining the ball bearings, the inner ball bearing ring having spaced-apart tabs that interact with the safety tabs on the outer bearing ring to define rotational limits;

a fabric cover attached to the inner and outer bearing rings, the fabric cover comprising a flexible and tear-resistant material configured to limit movement of the individual's head and neck, wherein a tongue-and-groove attachment mechanism secures the fabric cover, the tongue-and-groove attachment mechanism including a groove formed in a fabric cover member and a flexible cylindrical component receivable within the groove, the fabric cover being retained by positioning the fabric cover around the flexible cylindrical component and sliding the flexible cylindrical component along the groove, and the fabric cover further including fasteners configured to secure the fabric cover to the inner ball bearing ring to prevent disconnection under impact;

a top ring positioned above the fabric cover, attachable to a helmet to allow controlled movement of the helmet in conjunction with the protective collar assembly, the top ring configured to connect to a receiver on the helmet through a tongue and groove interface, with locking pins for quick release and secure attachment.

2. The protective collar assembly of claim 1, wherein the fabric cover further includes cutouts configured to expose the individual's face or neck region, the fabric cover being constructed from.

3. The protective collar assembly of claim 1, wherein the ball bearing assembly is a thrust bearing that enables frictionless rotation of the protective collar assembly.

4. The protective collar assembly of claim 1, wherein the locking pins of the top ring provide a locking and unlocking mechanism for attachment and detachment of the helmet.

5. The protective collar assembly of claim 1, further comprising bearing seals positioned above and below the ball bearing assembly to prevent debris intrusion and retain lubricant within the ball bearing assembly.

6. The protective collar assembly of claim 1, wherein the top ring includes first and second latches, each latch comprising a latch pin configured to project into a corresponding aperture formed in the receiver of the helmet, and a spring concentrically positioned around each latch pin to bias it into a locked position.

7. The protective collar assembly of claim 1, wherein the top ring includes a tenon joint formed along a rear portion of the top ring, the tenon joint configured to interlock with a mortise structure on the receiver of the helmet to reduce lateral play and improve alignment.

* * * * *